United States Patent [19]

Robjent

[11] 4,342,250

[45] Aug. 3, 1982

[54] HARMONICA

[75] Inventor: Frederick B. Robjent, Orchard Park, N.Y.

[73] Assignee: The Quaker Oats Company, Chicago, Ill.

[21] Appl. No.: 114,258

[22] Filed: Jan. 22, 1980

[51] Int. Cl.[3] ..... G10D 7/12

[52] U.S. Cl. ..... 84/377

[58] Field of Search ..... 84/377, 378

[56] References Cited

U.S. PATENT DOCUMENTS 2,595,316 5/1952 Wetzler ..... 84/377

2,827,818 3/1958 Bibus ..... 84/377

FOREIGN PATENT DOCUMENTS 352163 4/1922 Fed. Rep. of Germany ..... 84/377

*Primary Examiner*—Lawrence R. Franklin

*Attorney, Agent, or Firm*—Cumpston & Shaw

[57] ABSTRACT

A harmonica has a reed plate with a plurality of reeds overlying slots in the plate. The reed plate is mounted in a chamber of a housing, and the harmonica is played by forcing air from the player's mouth through passages in the housing and past the reeds. If a reed becomes separated from the plate, it is trapped in the chamber. This prevents a separated reed from travelling along the passages into the mouth of the player and possibly injuring the player.

8 Claims, 7 Drawing Figures

HARMONICA

BACKGROUND OF THE INVENTION

This invention relates to an improved construction for a harmonica. As described in more detail later in connection with FIG. 1, typical prior art harmonicas have a reed plate mounted within a housing, and air passages communicate directly with the reed plate from the exterior of the housing. When playing the hormonica, the harmonica player places his mouth against the housing and forces air through the passages by blowing and sucking air through the passages. This air travels past reeds on the reed plate to vibrate the reeds and produce sound. Sometimes the reeds become separated from the reed plate. If this occurs while the harmonica is being played, the reed can be inhaled into the harmonica player's mouth, enter the throat of the player, and possibly injure the player.

SUMMARY OF THE INVENTION

The improved harmonica construction of the present invention eliminates the possibility of injury to the harmonica player by inhaling a reed which has become separated from the reed plate. The harmonica comprises a reed plate having a plurality of elongate slots. A plurality of reeds are secured to the plate with each of the reeds overlying a slot in the plate. A housing has walls that define an enclosed chamber, and the plate is positioned within that chamber. The housing also has a plurality of air passages that extend from the exterior of the housing into the chamber so that the harmonica can be played by forcing air through the passages to the chamber and past the reeds. The size and shape of the passages relative to the reeds is effective to block travel of a reed from the chamber through the passages to the exterior of the housing in the event a reed becomes separated from the plate.

BRIEF DESCRIPTION OF THE DRAWINGS

In the following description of the invention, reference is made to the accompanying drawings, in which.

DETAILED DESCRIPTION OF THE INVENTION

Figure 1:
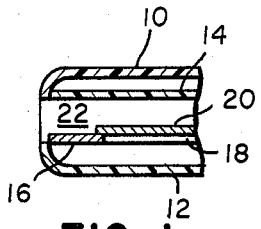
FIG. 1 ( PRIOR ART )
FIG. 1 is a fragmentary, cross-section view illustrating a typical prior art harmonica.
Figure 5:
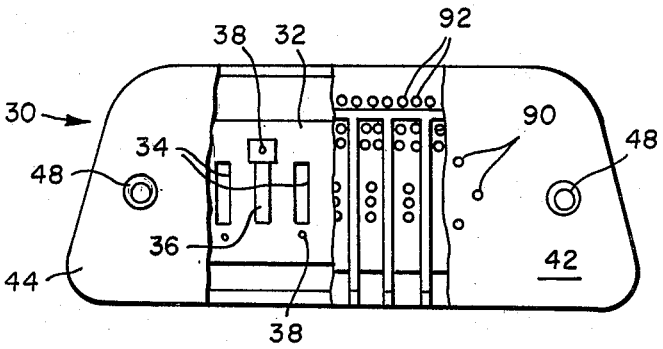
FIG. 5 is a plan view with portions cut away to show the construction of the harmonica at various levels.
Figure 2:
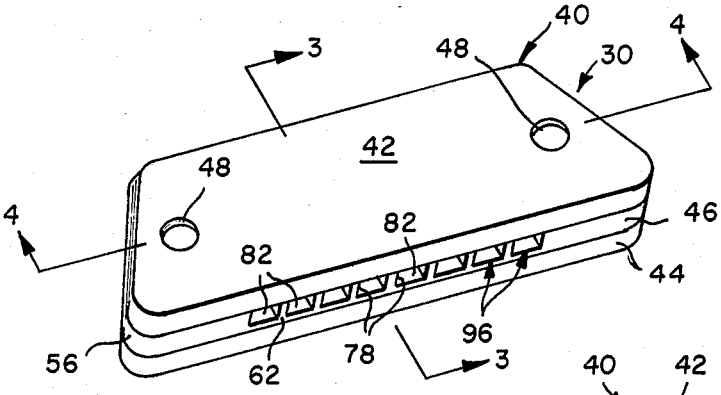
FIG. 2 is a perspective view illustrating a harmonica in accordance with the present invention.

Before preceeding with the description of the present invention, the typical prior art harmonica illustrated in FIG. 1 will be described. The harmonica comprises an upper housing member 10, a lower housing member 12 and an intermediate housing member 14. A reed plate 16 is mounted within the housing, and it has a plurality of openings, one of which is shown at 18. A reed 20 is provided for each opening 18 and is secured to the plate 16 so that air forced through opening 18 causes the reed to vibrate to produce sound. The reed plate 16 and reeds 20 communicate directly with a plurality of straight passages 22 defined by the housing members. In order to play the harmonica, the player places his mouth on the left side of the harmonica, as viewed in FIG. 1, and forces air into, or sucks air out of, the passages 22. As noted earlier, sometimes the reeds 20 become separated from the reed plate. If this occurs, then when the harmonica player sucks air through the passage 22, the reed can travel along the passages, enter the harmonica player's mouth, and possibly injure the player.

Figure 3:
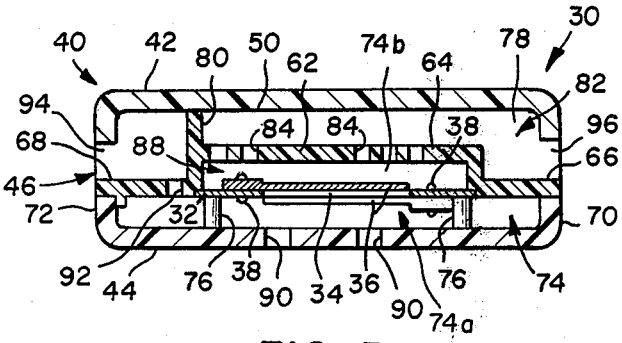
FIG. 3 is a transverse cross-section taken generally along line 3—3 of FIG. 2.
Figure 4:
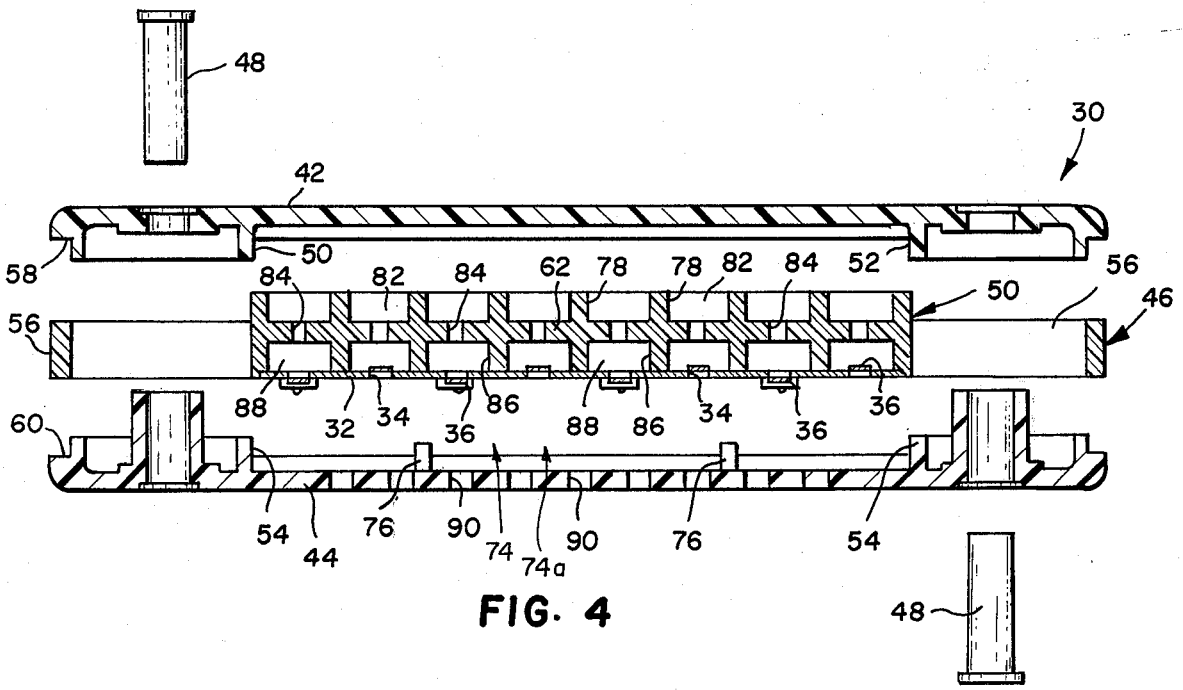
FIG. 4 is an exploded longitudinal cross-section taken generally along line 4—4 of FIG. 2.
Figure 6:
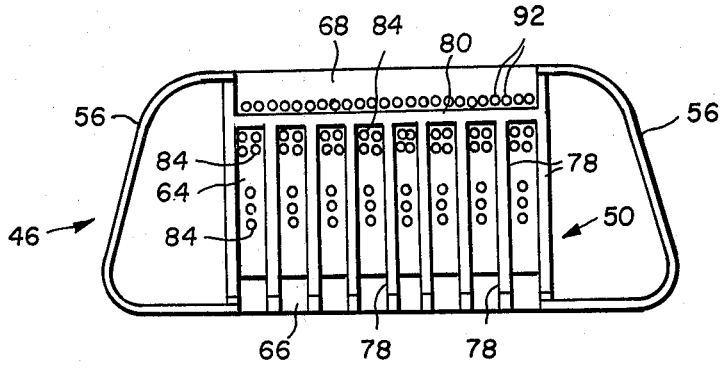
FIGS. 6 and 7 are views of the top and bottom, respectively, of the central housing member.
Figure 7:
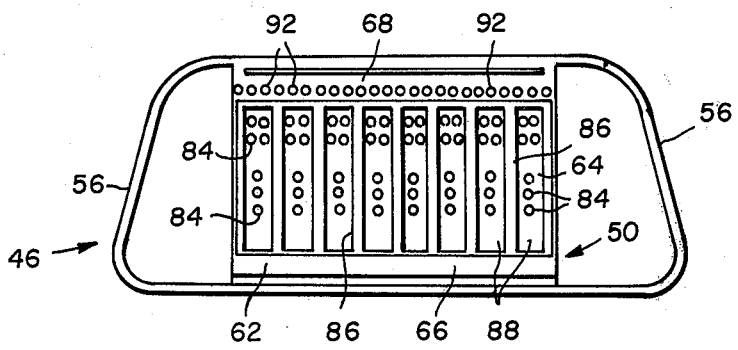

Referring now to FIGS. 2–5, a harmonica of the present invention is generally designated 30. As with the prior art harmonicas, the harmonica of the present invention includes a reed plate 32 that has a plurality of elongate, spaced and generally parallel slots 34. A plurality of reeds 36 are secured to the reed plate by pins 38. One reed 36 is provided for each slot 34. One half of the reeds are located on one side of the plate, and the other half are located on the opposite side of the plate with the reeds alternating so that, as shown in FIG. 4, the odd numbered slots are covered by reeds secured to one side of the plate, while the even numbered slots are covered by reeds secured to the other side of the plate. This construction of the reed plate and the reeds is similar to prior harmonicas.

The harmonica 30 comprises a housing generally designated 40 that includes a top housing member 42, a bottom housing member 44 and a central housing member 46 that is sandwiched between the top and bottom housing members. The housing members can be molded from suitable plastic materials and held in assembled relation by a pair of rivets 48 and/or by an adhesive.

Referring now to FIGS. 3–7, the central housing member 46 includes a generally rectangular intermediate portion 50 that fits between a pair of spaced, generally parallel flanges 52 on the top housing member 42 and a similar pair of spaced, parallel flanges 54 on the bottom housing member 44. Projecting from the ends of the intermediate portion 50 of housing member 46 is a pair of end walls 56 that fit into stepped recesses 58 and 60 in the outer periphery of the top and bottom housing members 42 and 44, respectively. This construction provides a smooth continuous edge surface around the end of the harmonica. Rivets 48 project through the portions of the harmonica bounded by the end walls 56 and the flanges 52 and 54.

The intermediate part 50 of the central housing member comprises a web 62 that is stepped in a transverse direction (as shown in FIG. 3) to form an elevated central web portion 64, a forward recessed portion 66 that extends to the front side of the harmonica, and a rearward recessed portion 68 that extends to the rear of the harmonica. The forward recessed portion 66 is seated on an upwardly projecting flange 70 on the bottom housing member 44, and the rearward recessed portion 68 engages a similar flange 72 on member 44. Thus a chamber 74 is defined by the bottom housing member 44 and by the web 62. The reed plate 32 is seated in a rectangular groove formed in the lower surface of the web 62 in spaced relation to the central web portion 64. The reed plate can be cemented to the web 62 and also is held in place by a plurality of posts 76 that project upwardly from the inner surface of the bottom housing member 44. This mounting of the reed plate locates it within the chamber 74, and the reed plate separates the chamber into a lower chamber portion **74*a* and an upper chamber portion 74*b***.

A plurality of walls 78 project upwardly from web 62 of the central housing member and engage the lower surface of the top housing member 42. Each of the walls 78 extend from an opening at the right side of the harmonica (as viewed in FIG. 3) inwardly to a wall 80 which projects upwardly from the web 62 and extends in a direction perpendicular to the walls 78. Wall 80 also contacts the lower surface of the top housing member 42. A total of nine walls 78 are provided and, in combination with wall 80 and the web 62 and housing member 42, define a total of eight passages 82 that are located between the web 62 and the housing member 42 and on the side of the web opposite from chamber 74. One of these passages 82 is provided for each of the reeds 36 on the reed plate and the passages directly overlie the various reeds, as best illustrated in FIG. 4. Web 62 has a plurality of ports therethrough and arranged in rows so that a total of seven ports 84 extend through the web and communicate with each of the passages 82. Two pair of two ports 84 are located adjacent wall 80, and the other three ports for a particular passage are spaced from the wall 80 and from the other four ports. Ports 84 provide fluid communication between the chamber **74*b* and each of the passages 82**.

Projecting downwardly from central portion 64 of web 62 is another set of spaced, generally parallel walls 86. Each of the walls 86 is aligned with one of the walls 78 from the set on top of the web 62. Walls 86 each engage one surface of the reed plate 32 at the side of the slots 32 in the reed plate. Thus the set of walls 86, the web 62, and the reed plate 32 separate the upper portion **74*b* of the chamber 74 into a plurality of passages 88, each of which underlies one of the passages 82 above the web. Ports 84 provide fluid communication from the passages 82 into the passages 88**.

The bottom housing member 44 has a plurality of ports 90 which provide passages for air into and out of the lower part **74*a* of chamber 74. Also, ports 92 in the rearward recessed portion 68 of the web 62 provide communication for air from the atmosphere into and out of chamber part 74*a*. This communication is provided, in part, due to the opening 94 in the central housing portion rearwardly of wall 80. There is a similar opening 96 at the end of each of the passages 82** at the front of the harmonica where the mouth of the harmonica player engages the housing when playing the harmonica.

A harmonica player can play the instrument by placing the mouth at the front of the harmonica and blowing or sucking air through the opening 96. This directs air through the various passages, ports or the like to cause air to pass over the reeds to produce a sound. More specifically, when air under pressure is forced into the opening 96, it travels through a passage 82 along a tortuous path defined by the forward recessed portion 66 of web 62, the central portion 64 of the web and the inner surface of the top housing member 42. Air then passes through the ports 84 and enters the upper chamber portion **74*b*. Air forced through one of the passages 82 will pass through the corresponding ports 84 and into the passage 88 immediately therebeneath. This air can then pass through the slot 34 surrounded by the passage 88 and past the corresponding reed 36 to vibrate the reed to produce sound. This air enters the lower part 74*a* of the chamber and is discharged to the atmosphere through ports 90 in the bottom housing member, or through ports 92 and the opening 94** in the rear of the harmonica housing.

In a similar manner, when suction is applied at the opening 96 at the front of the harmonica, air is drawn into the lower chamber portions **74*a* through the air ports 90, or through the rear opening 94 and ports 92. This air then passes upwardly through one of the slots 34 in the reed plate, and past a corresponding reed 36 to produce sound. The air enters the upper chamber part 74*b* and one of the passages 88 and then travels through the ports 84 into the passage 82 immediately thereabove. The air travels through passage 82 and then through the opening 96 into the harmonica player's mouth. By moving the mouth along the front of the harmonica, air can be drawn through, or forced into, each of the various passages 82** to vibrate different reeds, thereby producing different musical notes.

As mentioned earlier, one of the problems with the prior art harmonicas is that it is possible for the reeds to become separated from the reed plate and drawn into the mouth of the harmonica player to produce an injury to the person playing the harmonica. The harmonica in accordance with the present invention locates the reed plate and the reeds fully within the chamber 74. If a reed becomes separated from the plate, it is trapped within that chamber and held by the various walls of the harmonica surrounding the chamber so that it cannot possibly be drawn into the harmonica player's mouth. More specifically, the passages 88 are rather shallow and one of the long, narrow reeds cannot be tilted sufficiently within chamber port **74*a* to be passed upwardly through the ports 84. Also, ports 84 are smaller in size than the width of the reeds to prevent the reeds from moving through the ports. In addition, even if the reed could pass through the ports it would engage the inner surface of the top housing member 42 and be unable to turn sufficiently to travel along the passage 82 to the opening 96 in the front of the harmonica. Note, also, that the stepped configuration of the web 62, including the elevated central portion 64 and the recessed forward portion 66 thereof would block movement of a reed through the opening 96 in the front of the harmonica. Thus the tortuous path that is traveled by the air between the reed plate and the opening 96 in front of the harmonica prevents a separated reed from reaching the front of the harmonica where it can enter the harmonica player's mouth. In the event the reed breaks from the bottom of the harmonica plate and falls into the lower part 74*a* of the chamber, it is trapped therein because it cannot pass through the relatively small ports 90 and 92 in the bottom housing member 44 and the rearward recessed portion 68** of the web.

While the invention has been described in detail with particular reference to a preferred embodiment thereof, it will be understood that variations and modifications can be effected within the spirit and scope of the invention.

I claim:

1. A harmonica comprising:

first, second and third members cooperating to form a housing, said first and second members forming outer walls of said housing and said third member dividing said housing into first and second chambers;

a plurality of first passages extending through said first member from the exterior of said housing into said first chamber;

a plurality of second passages through said second member from said second chamber to the exterior of said housing;

a reed plate having a plurality of reeds attached thereto disposed within said second chamber;

a plurality of third passages through said third member, from said first chamber to said second chamber, said second and third passages characterized by a size and shape effective to block the passage of a reed out of said second chamber in the event a reed becomes separated from said plate.

2. A harmonica, as set forth in claim 1, further comprising a plurality of walls in said first and second chambers, the walls being generally parallel to each other and the walls in said first chamber being generally aligned with the walls in said second chamber.

3. A harmonica, as set forth in claim 2, wherein said third member comprises a web disposed between the walls in said first chamber and the walls in said second chamber, said third passages providing fluid communication between said first and second chambers through the web.

4. A harmonica, as set forth in claim 3, wherein the web has a stepped configuration comprising an elevated central portion and a recessed portion to form a tortuous path for air from chamber to the exterior of the housing.

5. A harmonica, as set forth in claim 1, wherein the third member has a plurality of walls projecting into the second chamber and into engagement with one surface of the reed plate, and the second member having a plurality of posts projecting into the second chamber and into engagement with the opposite surface of the reed plate.

6. A harmonica, as set forth in claim 1, wherein said third passages are disposed between a set of generally parallel walls on the third member, said walls extending to the first member, the walls being on the side of the third member opposite from the second chamber.

7. A harmonica, as set forth in claim 6, wherein the third member has a second set of generally parallel walls projecting into the second chamber and into engagement with the reed plate along lines generally parallel to and spaced from the reeds.

8. A harmonica, as set forth in claim 7, wherein the walls of each set of walls are parallel to the walls of the other set of walls and each wall of one set is aligned with a wall of the other set.

* * * * *